US007073548B1

(12) United States Patent
Berse-Hurley et al.

(10) Patent No.: US 7,073,548 B1
(45) Date of Patent: Jul. 11, 2006

(54) POP-UP PURSE

(75) Inventors: Cathy Berse-Hurley, Groton, MA (US); Charlotte Feldman, Groton, MA (US)

(73) Assignee: Little Packrats, Inc., Groton, MA (US)

( * ) Notice: Subject to any disclaimer, the term of this patent is extended or adjusted under 35 U.S.C. 154(b) by 47 days.

(21) Appl. No.: 10/457,061

(22) Filed: Jun. 6, 2003

(51) Int. Cl.
*A45C 3/06* (2006.01)

(52) U.S. Cl. ..... 150/127; 150/119; 229/188; 383/4

(58) Field of Classification Search ..... 150/127, 150/128, 119; 383/4; 229/188; 190/107
See application file for complete search history.

(56) References Cited

U.S. PATENT DOCUMENTS

| | | | | | |
|---|---|---|---|---|---|
| 15,891 | A | | 10/1856 | Mason | |
| 255,089 | A | | 3/1882 | Schrader | |
| 271,974 | A | * | 2/1883 | De Quillfeldt | 150/110 |
| 364,529 | A | | 6/1887 | Lieker | |
| 449,791 | A | | 4/1891 | Andrews | |
| 714,138 | A | * | 11/1902 | Brown | 229/192 |
| 1,068,802 | A | | 7/1913 | Merrell et al. | |
| 1,108,464 | A | * | 8/1914 | Morey | 229/102 |
| 1,166,336 | A | * | 12/1915 | Despot | 150/107 |
| 1,985,111 | A | * | 12/1934 | Shofer et al. | 229/117.05 |
| 2,009,077 | A | | 7/1935 | Walitzky | |
| 2,331,802 | A | * | 10/1943 | Rosenkrantz | 150/128 |
| 2,341,762 | A | * | 2/1944 | Conklin | 229/117.14 |
| 2,682,988 | A | * | 7/1954 | Rosen et al. | 229/117.22 |
| 2,737,221 | A | | 3/1956 | Knox | |
| 2,831,624 | A | * | 4/1958 | Lever | 383/4 |
| 3,173,465 | A | * | 3/1965 | Electra | 150/108 |
| 4,046,368 | A | | 9/1977 | LeBreton | |
| 4,201,331 | A | | 5/1980 | Austin | |
| 4,746,053 | A | | 5/1988 | Nichols | |
| 4,760,950 | A | * | 8/1988 | Levick | 229/103 |
| 4,904,230 | A | * | 2/1990 | Kawashima et al. | 474/112 |
| 4,934,588 | A | | 6/1990 | Johnske | |
| 5,094,385 | A | | 3/1992 | Antczak et al. | |
| 5,205,556 | A | | 4/1993 | Stallman | |
| 5,285,238 | A | * | 2/1994 | Quadracci et al. | 355/77 |
| 5,392,985 | A | | 2/1995 | Smith et al. | |
| 5,593,337 | A | | 1/1997 | Lapointe | |
| 6,044,970 | A | * | 4/2000 | Shinoda | 206/315.1 |
| 6,277,496 | B1 | * | 8/2001 | Lohwasser et al. | 428/469 |

OTHER PUBLICATIONS

Scott, G., "Origami to Go", *Threads,* pp. 46-49 (Jun./Jul. 1996).

* cited by examiner

*Primary Examiner*—Tri M. Mai
(74) *Attorney, Agent, or Firm*—Hamilton, Brook, Smith & Reynolds, P.C.

(57) ABSTRACT

A hand-bag is assembled by folding a single piece of material. The single piece of material is folded to form the walls, bottom portion and locking portions. The locking portions are engaged to hold the walls in position. The assembled hand-bag can be collapsed for storing.

7 Claims, 5 Drawing Sheets

POP-UP PURSE

BACKGROUND OF THE INVENTION

A hand-bag, purse or pocketbook is a bag used for carrying small personal articles or money that may be held in the hand or hung from a shoulder strap. The hand-bag typically has sufficient storage for carrying other articles such as, a purse for storing money, keys, credit cards, photographs and other small objects.

A hand-bag is typically manufactured by sewing or gluing separate pieces of material together.

SUMMARY OF THE INVENTION

A hand-bag manufactured from a single sheet of material that is inexpensive to manufacture and can be easily collapsed for storing is presented. The handbag includes a bottom portion, spaced apart front and back walls integrally formed with the bottom portion, spaced apart side walls integrally formed with the bottom portion, and locking portions. A first pair of locking portions is integrally formed with the front wall and the side walls. A second pair of locking portions is integrally formed with the back wall and the side walls. Each pair of locking portions includes a first member having a slot and a second member having a pair of slits. The slits and slot are engaged to support the walls.

The hand-bag may also include a flap integrally formed with the back wall. A handle may be coupled to the flap. The hand-bag may also include a lock for coupling the interior surface of the flap to the exterior surface of the front wall.

The bottom portion, walls, locking portions, and flap may, for example, be formed from a lenticular-coated material, leather, vinyl, plastic or paper.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
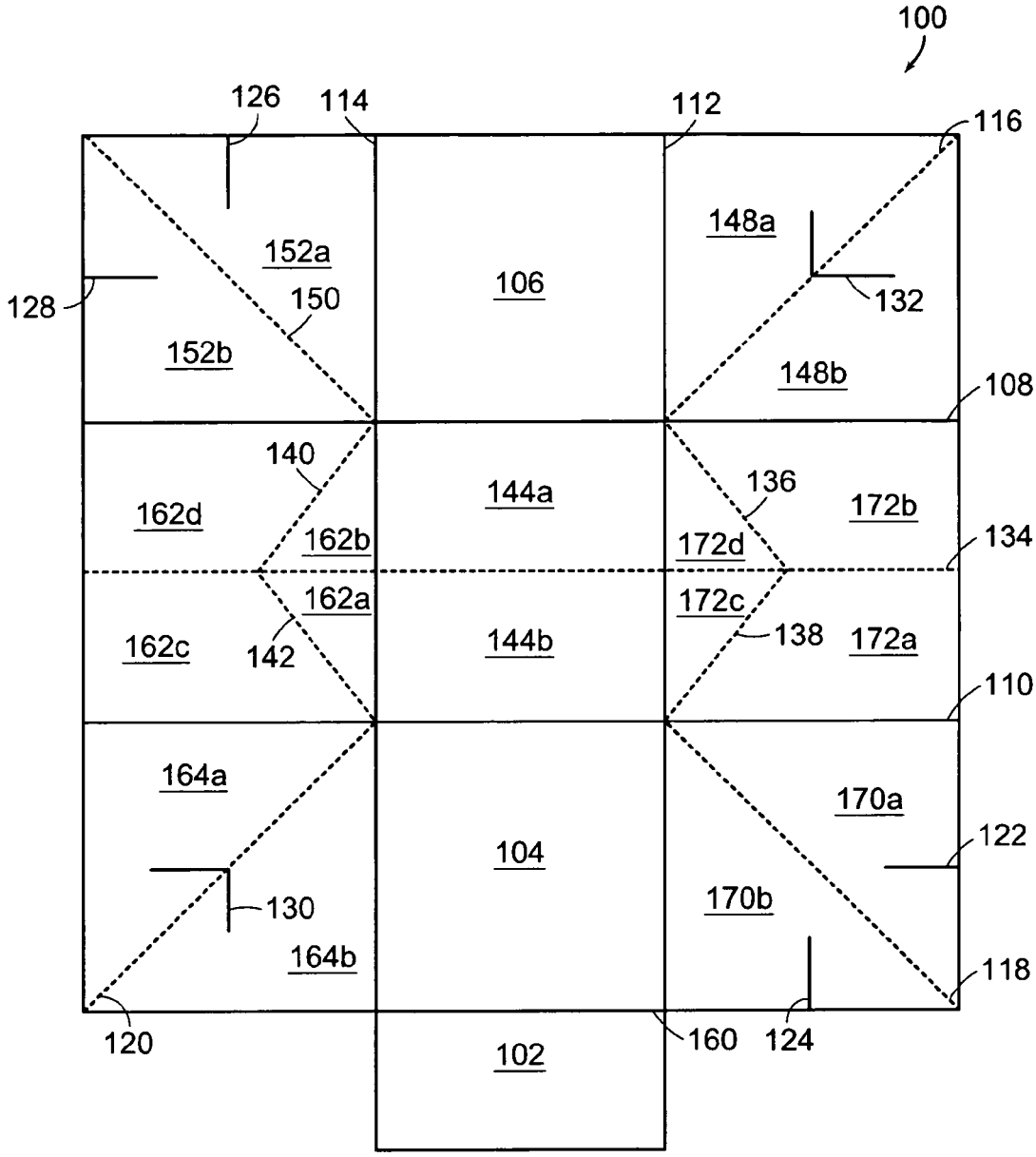
FIG. 1 is a top view of a blank for manufacturing a hand-bag according to the principles of the present invention.

FIG. 1 is a top view of a blank 100 for assembling a hand-bag according to the principles of the present invention. The blank 100 is a single sheet of material. The hand-bag is assembled from the blank 100 with no gluing or sewing required. Thus, the hand-bag is inexpensive to manufacture.

Primary fold lines 108, 110, 112, 108, 160 and 114 divide the blank 100 into ten rectangular portions, a bottom portion 144*a–b*, a front wall 106, a back wall 104, two side walls 172*a–d*, 162*a–d*, a first pair of locking portions 152*a–b*, 148*a–b*, a second pair of locking portions 164*a–b*, 170*a–b* and a flap 102.

Each pair of locking portions includes a respective slot 132, 130 and a respective pair of slits 126, 128, 122,124. The hand-bag is assembled by first folding the blank 100 along the primary fold lines 114, 112, 108, 110, then folding the locking portions 152*a–b*, 148*a–b*, 164*a–b*, 170*a–b* along secondary fold lines 150, 116, 118, 120 and finally engaging each respective slot with a corresponding pair of slits in each pair of locking portions.

Secondary fold lines 134, 136, 138, 142, 140 allow the assembled hand-bag to be configured in an open position, closed position and collapsed position. In the open position, the walls 162*a–d*, 172*a–d*, 106, 104 are held substantially perpendicular to the bottom portion. In the closed position, the flap 102 extends over the front wall 106 and is coupled to the front wall 106 such that the top of the front wall 106 and the top of the back wall 104 meet. Side walls 162*a–d*, 172*a–d* are partially folded along secondary fold lines 136, 138, 140 and 142 such that, the side walls 172*a–d*, 162*a–d* extend inward toward the center of the hand-bag.

While folded along secondary fold line 134, the hand-bag is in the collapsed position, with the bottom portions 144*a*, 144*b*, side walls 162*a–d*, 172*a–d* substantially parallel to the front wall, back wall and flap. The hand-bag is essentially flat and can be easily stored. The open, closed and collapsed positions will be described in greater detail later in conjunction with FIGS. 6–9.

Figure 2:
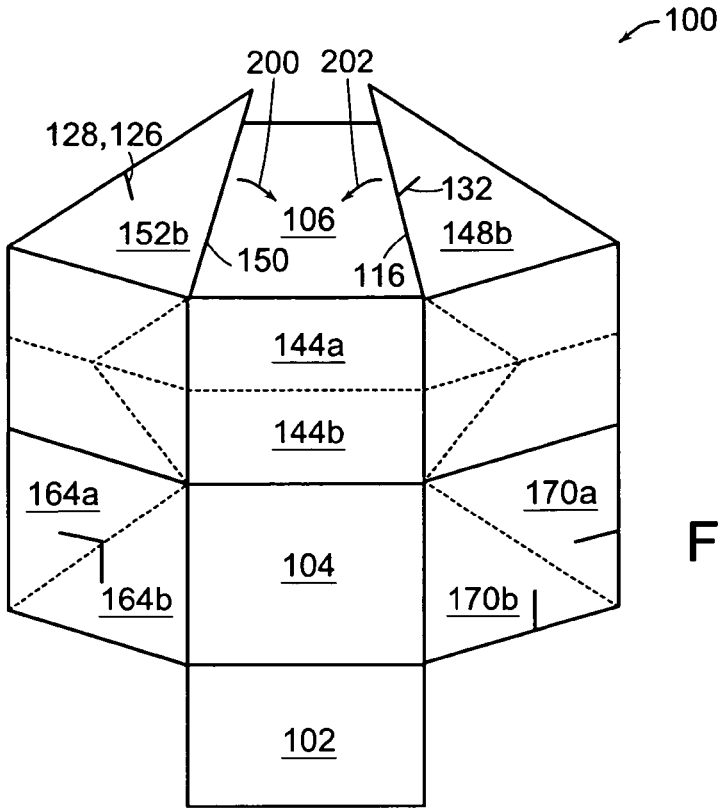
FIG. 2 is a perspective view of a partially assembled hand-bag illustrating the movement of members of a first pair of locking portions.

FIGS. 2–6 illustrate the assembly of the hand-bag from the blank 100 shown in FIG. 1. FIG. 2 is a perspective view of a partially assembled hand-bag illustrating the movement of members of a first pair of locking portions 152*a–b*, 148*a–b*. As discussed in conjunction with FIG. 1, the side walls 162*a–d*, 172*a–d* are formed by folding the blank 100 along primary fold lines 114, 112. The front wall 106 and back wall 104 are formed by folding the blank 100 along primary fold lines 108, 110. As the side walls are being formed by folding along primary fold lines 114, 112, the first pair of locking portions 152*a–b*, 148*a–b* are folded along respective secondary fold lines 150, 116. As shown, locking portion 152*a–b* is folded along secondary fold line 150 and locking portion 148*a–b* is folded along secondary fold line 116. Slits 126, 128 in the locking portion 152*a–b* are positioned along the perimeter of the blank 100 such that when folded along secondary fold line 150, the slits 126, 128 are at the same position on the folded locking portion.

While folded along secondary fold line 150, locking portion 152*a–b* is moved in direction 200 toward the center of the blank 100. Locking portion 148*a–b* is folded along secondary fold line 116. The folded locking portion 148*a–b* is moved downwardly in direction 202 toward the bottom portion 144*a–b*. Locking of the locking portions 152*a–b*, 148*a–b* is achieved by the inter-engagement of the slits 128, 126 and the slot 132. After engagement, the locking portions are aligned with the front wall 106.

Figure 3:
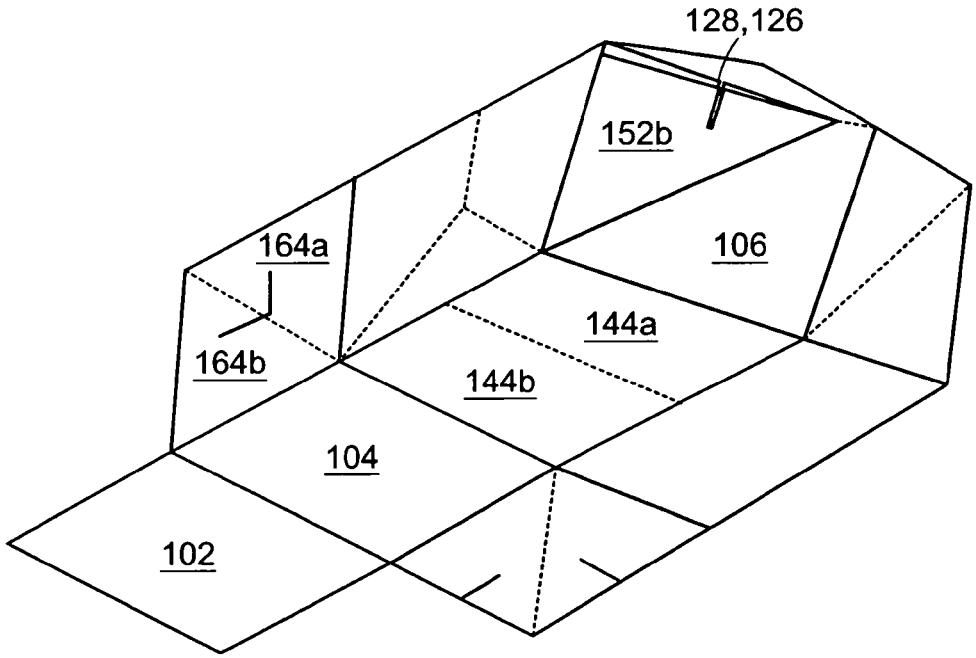
FIG. 3 is a perspective view of the partially assembled hand-bag illustrating the position of one of the members of the first pair of locking portions after it has been moved as shown in FIG. 2.

FIG. 3 is a perspective view of the partially assembled hand-bag illustrating the position of one of the members of the first pair of locking portions 152*a–b* after it has been folded and moved as shown in FIG. 2. The locking portion is folded such that the slits 128, 126 meet at the top of the folded locking portion 152*a–b*.

Figure 4:
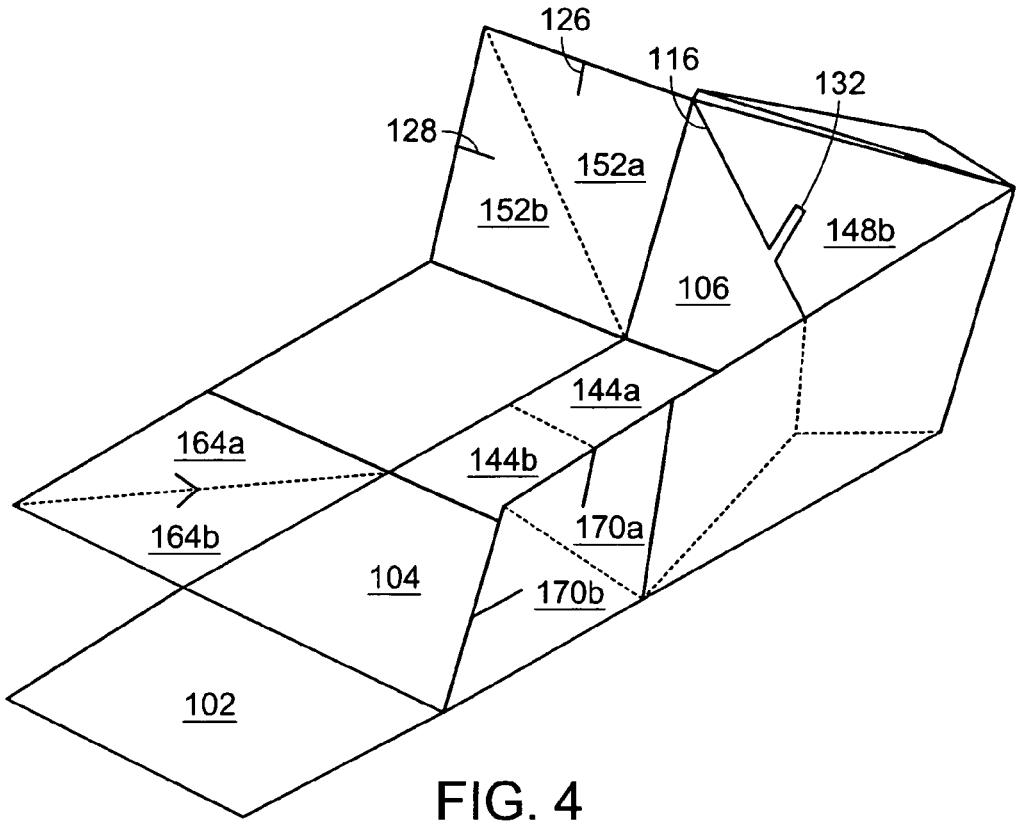
FIG. 4 is a perspective view of the partially assembled hand-bag illustrating the position of the other members of the first pair of locking portions after it has been moved as shown in FIG. 2.

FIG. 4 is a perspective view of the partially assembled hand-bag illustrating the position of the other member 148*a–b* of the first pair of locking portions after it has been folded and moved as shown in FIG. 2. The locking portion 148*a–b* is folded such that the slot 132 forms a slit on secondary fold line 116 of the folded locking portion.

Figure 5:
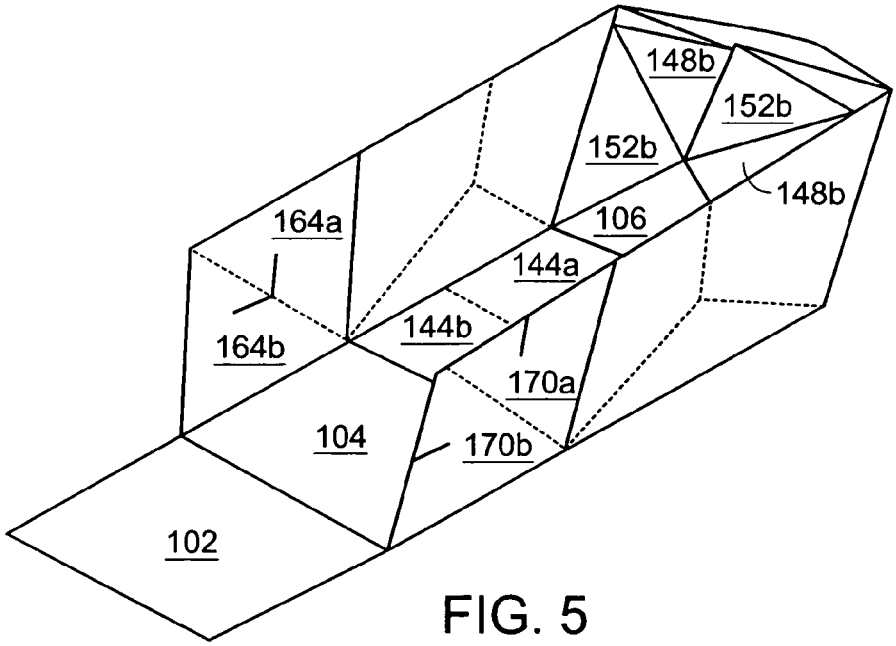
FIG. 5 is a perspective view of the partially assembled hand-bag shown in FIG. 2 after engagement of the first pair of locking portions.

FIG. 5 is a perspective view of the partially assembled hand-bag shown in FIG. 2 after engagement of the folded first pair of locking portions 152*a–b*, 148*a–b*. The first pair of locking portions 152*a–b*, 148*a–b* are locked by the inter-engagement of the pair of slits 128, 126 and the slot 132 to support the front wall 106 and side walls 162*a–d*, 172*a–b*. After the first pair of locking portions 152*a–b*, 148*a–b* are engaged, the second pair of locking portions 164*a–b*, 170*a–b* are engaged to support the back wall 104 and side walls 162*a–d*, 172*a–d*. The second pair of locking portions 164*a–b*, 170*a–b* includes a pair of slits 122,124 and a slot 130. Locking portions 164*a*, 164*b* are folded along secondary fold line 120 and locking portions 170*a*, 170*b* are folded along secondary fold line 118. Each member of the pair of locking portions is moved toward the bottom portion 144*a–b* to engage the slot 130 with the slits 122, 124. While engaged, the second pair of locking portions supports the side walls 162*a–d*, 172*a–d* and back wall 104.

The assembled hand-bag can be configured in three different positions; open, closed and collapsed.

Figure 6:
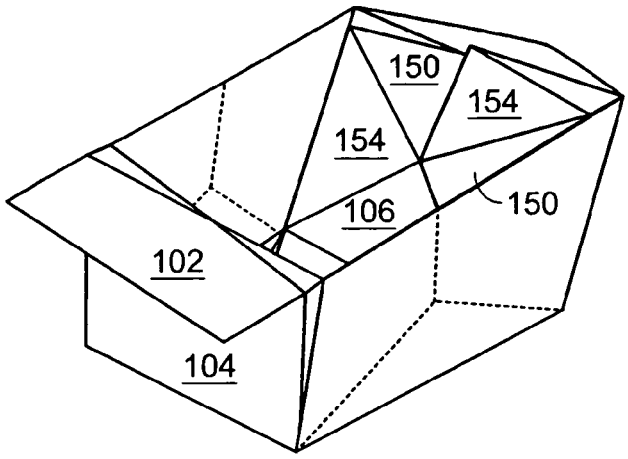
FIG. 6 is a perspective view of the assembled hand-bag in the open position with both pairs of locking portions engaged.

FIG. 6 is a perspective view of the assembled hand-bag in the open position with both pairs of locking portions engaged. In the open position, the hand-bag includes spaced apart front and back walls substantially parallel to each other and spaced apart side walls substantially parallel to each other to form a box shape. The two pairs of engaged locking portions are aligned with the back wall 106 and the front wall 104 respectively. The walls (front, back and side) are substantially perpendicular to the bottom portion 14*a–b*. While in the open position, items can be easily inserted and removed from the hand-bag.

Figure 7:
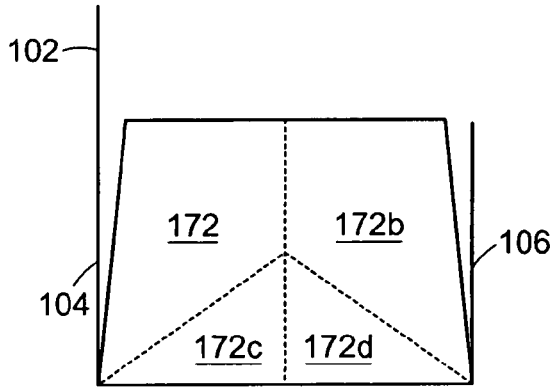
FIG. 7 is a side view of the assembled hand-bag in the open position.

FIG. 7 is a side view of the assembled hand-bag in the open position. The front wall 106 and back wall 104 are spaced apart. The first pair of locking portions are engaged to support the back walls. The second pair of locking portions are engaged to support the front wall.

Figure 8:
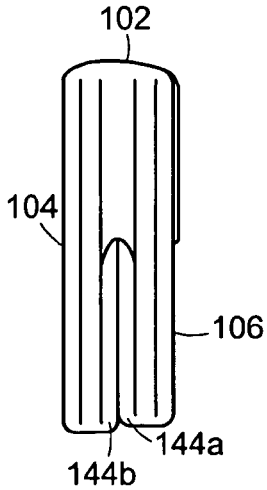
FIG. 8 is a side view of the assembled hand-bag in the collapsed position.

When not being used to store items, the hand-bag can be collapsed. FIG. 8 is a side view of the assembled hand-bag in the collapsed position. Returning to FIG. 1, the hand-bag is collapsed by folding the bottom portion 144*a–b* and side walls 162*a–d*, 172*a–d* along secondary fold line 134. While collapsed, the hand-bag occupies less space which is beneficial for both storing and shipping the hand-bag. The hand-bag can be easily popped open from the collapsed position for storing items by unfolding the hand-bag along fold line 134.

Figure 9A:
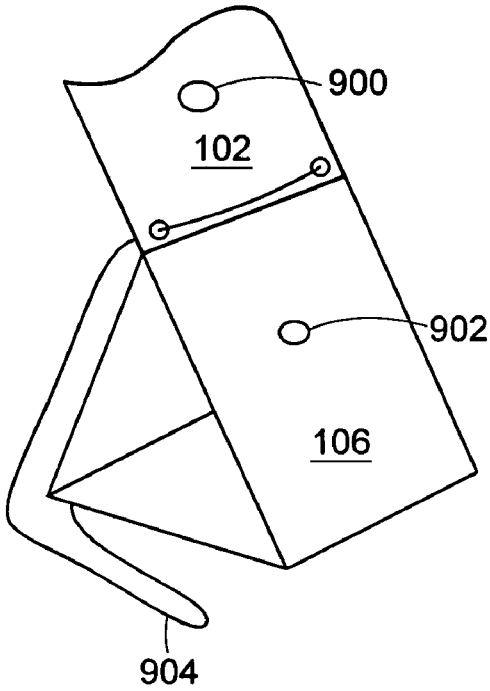
FIG. 9A is a perspective view of one embodiment of the assembled hand-bag in the open position.

FIG. 9A is a perspective view of one embodiment of the assembled hand-bag in the open position. Various means of coupling can be used to hold the hand-bag in the closed position with the flap 102 coupled to the exterior surface of the front wall 106. In the embodiment shown, the flap 102 is coupled to the front wall 106 by a piece of fabric of small hooks 900 coupled to the inside of the flap 102 that sticks to a piece of fabric of small loops 902 coupled to the front wall 106. In the embodiment shown, both pieces of fabric 900, 902 are shaped in the form of a circle. In alternate embodiments, the pieces of fabric can be other shapes. The flap shape is shown with a plurality of curves.

Figure 9B:
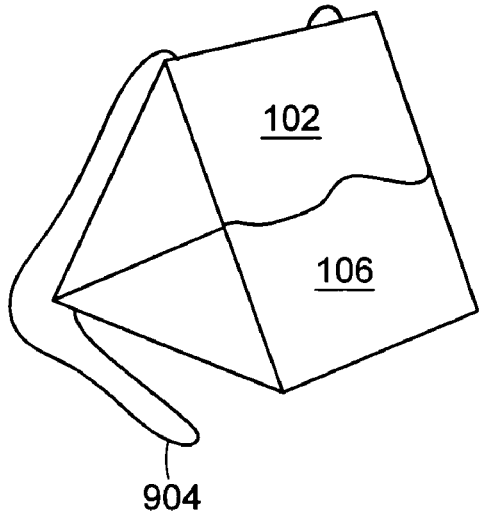
FIG. 9B is a perspective view of one embodiment of the assembled hand-bag in the closed position.

FIG. 9B is a perspective view of one embodiment of the assembled hand-bag in the closed position. While in the closed position, the side walls 162*a–d*, 172*a–d* are partially collapsed by partially folding the side walls along respective secondary fold lines 136,138, 134, 140, 142. With the side-walls partially folded, the proximal portion of the front wall and the back wall move toward the center of the hand-bag and the hand-bag is held in the closed position by coupling the interior surface of the flap to the exterior surface of the front wall 106.

The assembled hand-bag can be used for carrying small personal articles and can be held in the hand or hung from a shoulder strap. The hand-bag may also be referred to as a purse or a pocketbook. A handle 904 attached to the flap allows the handbag to be hung from the shoulder.

Figure 10:
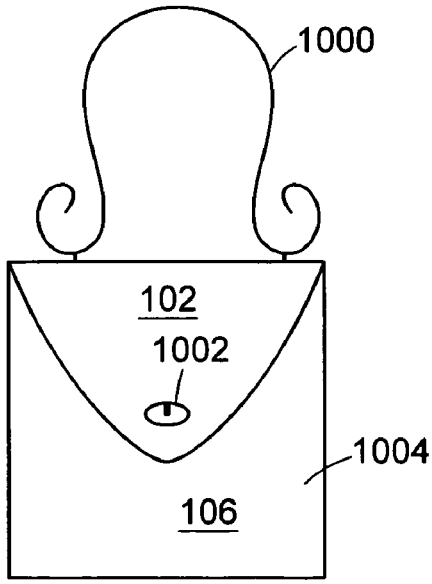
FIG. 10 is a front view of another embodiment of the assembled hand-bag in the closed position.

In an alternate embodiments, the means for coupling can be a magnetic snap or a turning clasp. FIG. 10 is a front view of another embodiment of the assembled hand-bag held in the closed position by coupling the flap 102 having a single curved edge to the exterior surface of the front wall using a turning clasp 1002. In one embodiment, the turning clasp is chrome plated. A handle 1000 coupled to the flap 102 allows the handbag to be held in the hand.

The hand-bag (see FIG. 10) can be made from a lenticular-coated material 1004, leather, vinyl, plastic, paper or any other type of material well-known to those skilled in the art. A lenticular-coated material includes special lenses ("lenticles") placed over multiple two-dimensional images printed in alternating bands. The lenticular-coated material 1004 appears to include a three-dimensional image because a different view of the two dimensional image is viewed from different angles through the lenticles.

The flap shape is shown in FIG. 10 with a single curved edge and in FIGS. 9A and 9B with a plurality of curves. In alternate embodiments, other shapes can be used, for example, a rectangle, or an arc.

While this invention has been particularly shown and described with references to preferred embodiments thereof, it will be understood by those skilled in the art that various changes in form and details may be made therein without departing from the scope of the invention encompassed by the appended claims.

What is claimed is:

1. A hand-bag comprising:

a bottom portion;

spaced apart front and back walls integrally formed with the bottom portion;

spaced apart side walls integrally formed with the bottom portion, a first pair of locking portions integrally formed with the front wall and the side walls;

a second pair of locking portions integrally formed with the back wall and the side walls, each pair of locking portions including a first member having a single slot and a second member having a pair of slits, the slits and slot engaged such that each of the first and second pairs of locking portions forms a wall extending the length of the respective front and back wall; and a flap integrally formed with the back wall;

wherein the hand-bag is in a closed position such that:

the handbag is partially folded along the secondary fold lines of the side walls;

the proximal portion of the front and back walls have moved towards the center of the hand-bag; and the interior surface of the flap is coupled to the exterior surface of the front wall to hold the hand-bag closed.

2. The hand-bag of claim 1 wherein the bottom portion, walls, locking portions and flap are formed from leather.

3. The hand-bag of claim 1 wherein the bottom portion, walls, locking portions and flap are formed from vinyl.

4. The hand-bag of claim 1 wherein the bottom portion, walls, locking portions and flap are formed from plastic.

5. The hand-bag of claim 1 wherein the bottom portion, walls, locking portions and flap are formed from paper.

6. The hand-bag of claim 1 further comprising:

a handle coupled to the flap.

7. The hand-bag of claim 1 further comprising:

a lock for coupling the interior surface of the flap to the exterior surface of the front wall.

* * * * *